US008490942B1

(12) United States Patent
Henry

(10) Patent No.: US 8,490,942 B1
(45) Date of Patent: Jul. 23, 2013

(54) APPARATUS AND METHODS FOR SECURING A MUSICAL INSTRUMENT

(76) Inventor: Richard Allan Henry, Dallas, TX (US)

( * ) Notice: Subject to any disclaimer, the term of this patent is extended or adjusted under 35 U.S.C. 154(b) by 0 days.

(21) Appl. No.: 13/371,713

(22) Filed: Feb. 13, 2012

(51) Int. Cl.
*A47B 19/00* (2006.01)

(52) U.S. Cl.
USPC ..... 248/441.1; 248/122.1; 248/443; 84/327; 206/314

(58) Field of Classification Search
USPC ..... 248/443, 121, 166, 122.1, 441.1, 248/451, 124.2, 154; 84/327; 211/85.6, 120; 403/322.3, 322.1, 322.4, 325; 297/186; 206/314
See application file for complete search history.

(56) References Cited

U.S. PATENT DOCUMENTS 6,209,829 B1 * 4/2001 Yu ..... 248/122.1
6,439,532 B1 * 8/2002 Yu ..... 248/443
6,513,768 B1 * 2/2003 Hsieh ..... 248/121
7,105,732 B1 * 9/2006 Hsieh ..... 84/327
7,906,717 B2 * 3/2011 Wang ..... 84/327

OTHER PUBLICATIONS http://www.mcmelectronics.com/product/STELLAR-LABS-555-13850-/555-13850 MCM Part #: 555-13850 | Stellar Labs Part #: 555-13850.

* cited by examiner

*Primary Examiner* — Todd M. Epps
(74) *Attorney, Agent, or Firm* — Yee & Associates, P.C.

(57) ABSTRACT

Apparatus and methods for securely storing a musical instrument. A support member supports the musical instrument at first portion of the musical instrument, the first portion is proximal to a base of the musical instrument. A grip member secures the musical instrument at a second portion of the musical instrument, the second portion is distal from the base of the musical instrument, the securing comprises the grip member changing from an opened position to a closed position in response to the musical instrument being placed onto the support member.

18 Claims, 3 Drawing Sheets

APPARATUS AND METHODS FOR SECURING A MUSICAL INSTRUMENT

BACKGROUND

This application relates to a stand for storing and securing a musical instrument.

Instrument stands are used to store musical instruments when such instruments are not in use. Depending on the nature of the use of a particular stand, various stands may be able to provide for quick accessability to the instrument being stored via the stand.

BRIEF DESCRIPTION OF THE FIGURES

Like reference numbers and designations in the various drawings indicate like elements.

DETAILED DESCRIPTION

Figure 1:
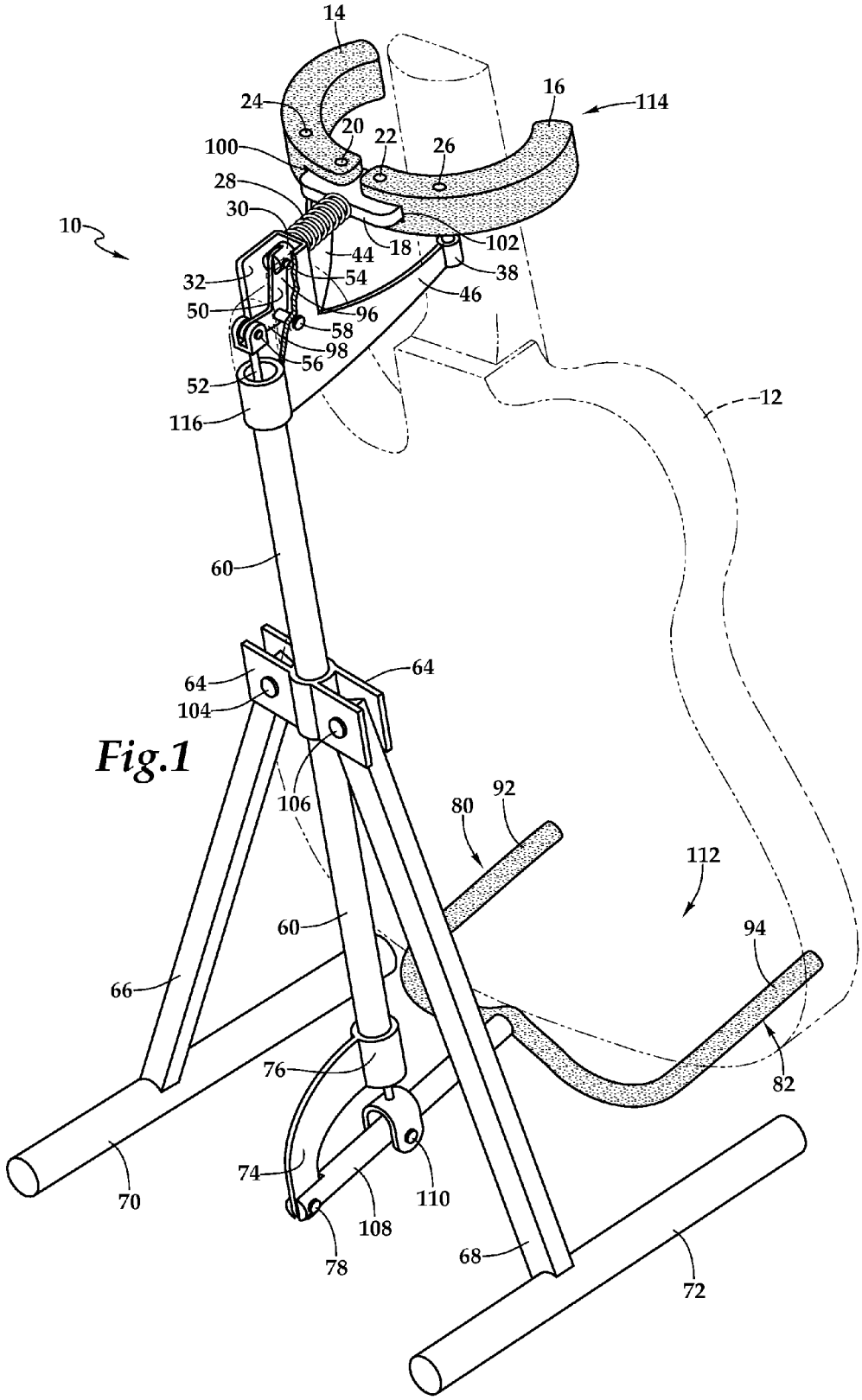
FIG. 1 is a perspective view of an embodiment that accords with the disclosure.

One or more specific embodiments of the present disclosure will be described below. In an effort to provide a concise description of these embodiments, all features of an actual implementation may not be described in the specification. It should be appreciated that in the development of any such actual implementation, numerous implementation-specific decisions must be made to achieve specific goals, such as compliance-related or business-related goals, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

A musical instrument, such as a guitar, needs to be securely stored when not in use, but also needs to be readily accessible. This is especially the case during a live performance when multiple guitars are being used by the same performer. In such a case, the instrument(s) needs to be securely stored and readily accessible but also needs to maintain all of its tuning A guitar can conveniently be leaned up against its amplifier or a wall, but this allows for passersby to easily knock over an instrument stored in this way and possibly losing the tuning of or otherwise damaging the instrument.

In accordance with the present disclosure, apparatus and methods provide for a musical instrument stand that securely stores a musical instrument and also allows for that musical instrument be readily accessible. As described in further detail below, a musical instrument stand includes a support member for supporting the musical instrument at a base portion of the musical instrument and the musical instrument stand includes grip member for holding the musical instrument in an upright position at a portion of the musical instrument other than the base portion. The support member and the grip member are linked so that when the musical instrument is placed onto the support member, the grip member will then change from an open position to a closed position in order to grip the top of the instrument and keep it upright and secured.

A mechanical connection between the support of member and the grip member is achieved by using multiple joints. As described in further detail below, the support member is connected via a pin joint to a second rod. The second rod is connected via another pin joint to an L-shaped member. The L-shaped member is connected via a pin joint to a first rod. The first rod is connected via two movable pin joints to the grip member. This mechanical connection allows for movements of the support member to be translated into movements of the grip member. Alternative embodiments may have multiple gears, cogs, sprockets, racks, pinions, combinations thereof, and so forth, for linking the motion of the support member to the motion of the grip member. As an example, one or more gears can be used so that the motion of the support member is converted into a twisting of the second rod to transfer the mechanical force from the support member to the grip member.

Additionally, while the embodiment described uses a mechanical linkage between the support of member and the grip member, the support member and the grip member can be linked by any sufficient means. As an example, the support member may include one or more electronic sensors that sense when a musical instrument is being placed onto and removed from the support member and/or stand. Signals from such electronic sensors could then be used as a basis to electronically control the opening and closing of the grip member, via, e.g., an electrical actuator.

Figure 3A:
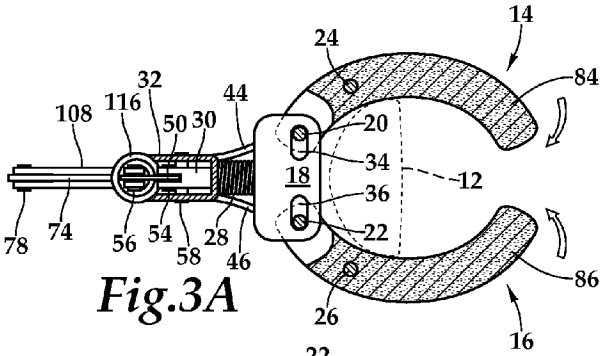
FIG. 3A is a top view of part of an embodiment that accords with the disclosure depicting a grip member in a closed position.
Figure 3B:
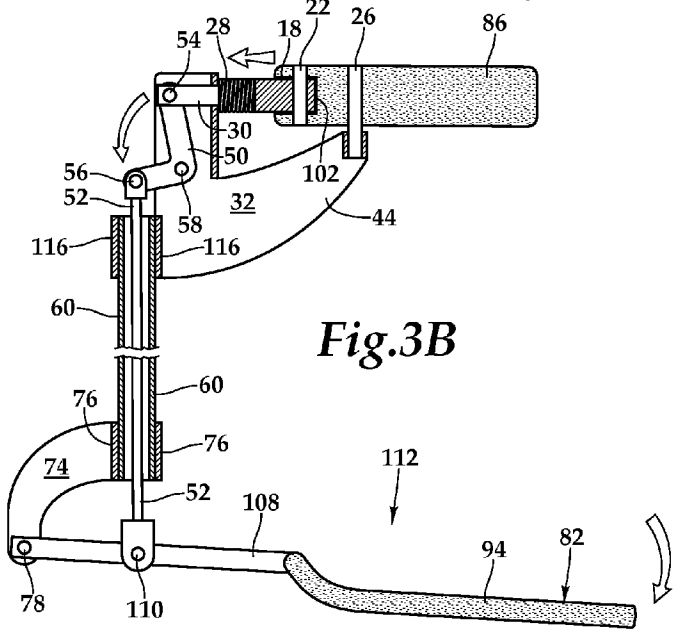
FIG. 3B is a side view of part of an embodiment that accords with the disclosure depicting a grip member in a closed position and the interconnection between the grip member and a support member.
Figure 2A:
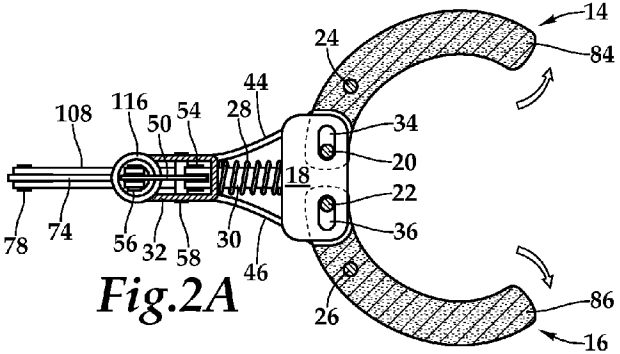
FIG. 2A is a top view of part of an embodiment that accords with the disclosure depicting a grip member in an open position.
Figure 2B:
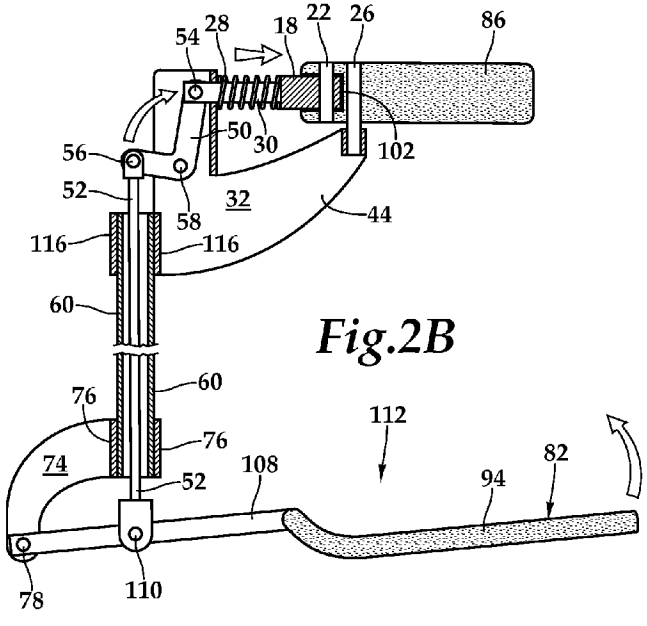
FIG. 2B is a side view of part of an embodiment that accords with the disclosure depicting a grip member in an open position and the interconnection between the grip member and a support member.

FIG. 1 is a perspective view of an embodiment that accords with the disclosure. FIG. 2A is a top view of part of an embodiment that accords with the disclosure depicting a grip member in an open position. FIG. 2B is a side view of part of an embodiment that accords with the disclosure depicting a grip member in an open position and the interconnection between the grip member and a support member. FIG. 3A is a top view of part of an embodiment that accords with the disclosure depicting a grip member in a closed position. FIG. 3B is a side view of part of an embodiment that accords with the disclosure depicting a grip member in a closed position and the interconnection between the grip member and a support member.

As shown in FIG. 1, an instrument stand 10 securely stores a musical instrument, e.g., a guitar 12. The instrument stand 10 includes a grip member 114 and a support member 112. The grip member 114 is changeable from an open position to a closed position based upon whether the guitar 12 is placed into the stand and actuates the support member 112. The grip member 114 comprises a grip half 14 and a grip half 16.

The grip half 14 and the grip half 16 work in combination to provide lateral support on both sides of a top portion of the musical instrument, e.g., the guitar 12. The grip halves 14 and 16 are made from any suitably rigid material so as to properly secure the musical instrument. Such rigid materials include wood, plastic, metal, combinations thereof, and so forth. The grip half 14 comprises: a coating 84, a pin joint 24, a pin joint 20, and a cavity 100. The grip half 16 comprises: a coating 86, a pin joint 26, a pin joint 22, and a cavity 102.

The coatings 84 and 86 are made of any suitably soft material(s) that can protect the instrument from the rigid material(s) of the grip halves 14 and 16. Such soft materials include rubber, synthetic rubber, plastic, neoprene, combinations thereof, and so forth.

The pin joint 24 is a stationary pin joint and the pin joint 20 is a movable pin joint. The grip half 14 rotates about the pin joint 24 as the pin joint 24 remains stationary with respect to a housing 32. The pin of the pin joint 20 may remain stationary with respect to the grip half 14 as the grip half 14 rotates and as the pin joint 20 slides in combination with a connecting piece 18. The combination of the stationary pin joint 24 and the moving pin joint 20 allow for the grip half to open and close in response to movements of the connecting piece 18 that are linked with movements of the support member 112, e.g., by placing a musical instrument onto the support member 112. The grip half 16 and the pin joints 26 and 22 operate in a similar manner as the grip half 14 and the pin joints 24 and 20, respectively.

The cavity 100 of the grip half 14 encloses a first portion of the connecting piece 18. Similarly the cavity 102 of the grip half 16 encloses a second portion of the connecting piece 18. As depicted, the cavities 100 and 102 create planar joints with at least a part of the connecting piece 18 so that the grip halves 14 and 16 can slide and rotate with respect to the connecting piece 18.

The connecting piece 18 connects a rod 30 with the grip halves 14 and 16 and provides one of the ends against which a spring 28 presses and expands. The connecting piece 18 comprises cavities 34 and 36.

The cavity 34 allows the pin of the pin joint 20 to slide laterally, which enables the lateral movement of the grip half 14. The cavity 36 allows the pin of the pin joint 22 to slide laterally, which enables the lateral movement of the grip half 16.

The spring 28 expands and presses against the connecting piece 18 and the housing 32. The spring 28 biases arms 80 and 82 in an up position and biases the grip halves 14 and 16 in an open position, so that the stand 10 is ready to receive a musical instrument when not in use.

The rod 30 connects the grip member 114 to an L-shaped member 50 via the connecting piece 18 and a pin joint 54, respectively. The rod 30 also keeps spring 28 in place against connecting piece 18 and the housing 32. In a suitable technique may be used to couple the rod 30 to the connecting piece 18, e.g., welding, adhesives, and so forth. Additionally, alternative embodiments may have that the connecting piece 18 and the rod 30 are formed from a single piece of material. The rod 30 can also be a cable or any other type of structure that can provide enough force to pull against the L-shaped member 50 and lift the support member 112 to the up position.

The housing 32 connects the grip member 114 to the tube 60 and supports the L-shaped member via pin joint 58. The housing 32 is made from any suitably rigid material so as to properly secure the musical instrument. Such rigid materials include wood, plastic, metal, combinations thereof, and so forth. The housing 32 comprises the pins for the pin joints 24 and 26, a coupling 116 to the tube 60, an opening 118 for the rod 30, the pin joint 58, an extension 44 for the pin joint 24, an extension 46 for the pin joint 26, and a coupling 38 between the housing 32 and the pin of the pin joint 26.

As discussed above the pin joints 24 and 26 are stationary and allow for the grip halves 14 and 16 to rotate between the opened and closed positions. The pin of the pin joint 26 is coupled to the housing 32 via the coupling 38. The pin of the pin joint 24 is coupled to the housing 32 via a similar coupling, not shown.

The opening 118 allows the rod 30 to pass through the housing so that movements of the support member 112, transferred via the L-shaped member 50, are then transferred to the grip member 114. While depicted merely as an opening within the housing, the opening 118 could be extended to cover the rod 30 and the spring 28 and at least a portion of the grip member 114. Doing so would provide protection for the mechanisms that allow the grip member 114 to operate.

The extension 44 of the housing 32 connects the tube 60 to the pin joint 24. Similarly, the extension 46 of the housing 32 connects the tube 60 to the pin joint 24.

The pin joint 58 supports the L-shaped member 50, which rotates about the pin of the pin joint 58. While this embodiment depicts the pin joint as a part of the housing 32, alternative embodiments may have the pin joint 58 as a part or extension of the tube 60.

The coupling 116 connects the housing 32 to the tube 60. As depicted, the coupling 116 extends around an outer surface of the tube 60 to provide the necessary support for the grip member 114 and all the mechanisms the grip member 114 is connected with.

The L-shaped member 50 connects the rod 30 with rod 52 to couple the movements of the rods 30 and 52. The L-shaped member 50 rotates about the pin or pivot of the pin joint 58. The L-shaped member 50 is coupled to rod 30 at the pin joint 54 and the L-shaped member 50 is coupled to rod 52 at the pin joint 56. The L-shaped member 50 is coupled to the housing 32 at the pin joint 58. The pin joint 58 acts as a hinge or pivot about which the L-shaped member 50 rotates.

The L-shaped member 50 comprises a first portion 96 and a second portion 98. A first distance associated to the first portion 96 that is between the first coupling at the pin joint 54 and the pivot is different from a second distance associated to the second portion 98 that is between the second coupling at the pin joint 56 and the pivot. The difference in length between the first portion 96 and the second portion 98 is chosen so that for a given movement of the support member 112, the grip member 114 will change from the opened position to the closed position, thereby securing the guitar 12 within the instrument stand 10.

The rod 52 connects the L-shaped member 50 to the support member 112. The rod 52 is coupled to the L-shaped member 58 at the pin joint 56. This coupling may comprise a slot within the rod 52 or a flange that extends from the rod 52. The rod 52 is coupled to the support member 112 at the pin joint 110. This coupling may comprise a slot within the rod 52 or a flange that extends from the rod 52. This coupling may comprise a slot within the rod 52 or a flange that extends from the rod 52. The rod 52 provides enough tension between the L-shaped member 50 and the support member 112 to transfer motions and movements between the support member 112 and the L-shaped member 50.

The tube 60, through which the rod 52 passes, provides rigid support to the musical instruments stand holding the group member 114 along with the guitar 12 in an upright position. The tube 60 is connected to the housing 32 via the coupling 116 and the tube 60 is connected to the extension 74 via the coupling 76. The tube 60 is also connected to a bracket 64, such connection may be slidable or adjustable so as to provide for changing the height of the instrument stand 10.

The bracket 64, through which tube 60 passes, couples the tube 60 to legs 66 and 68. While the bracket 64 is shown as a single piece, alternative embodiments can have the bracket 64 as a two pieces. The bracket 64 comprises pin joints 104 and 106, which connect the legs 66 and 68 to the bracket 64, respectively.

The legs and 66 and 68 operate to hold the musical instruments stand 10 upright and are connected to the bracket 64 at the pin joints 104 and 106, respectively. The pin joints 104 and 106 may act as pivots, about which the legs 66 and 68 rotate. The legs 66 and 68 also comprise bases 70 and 72, respectively. The legs 66 and 68 provide lateral support and the bases 70 and 72 provide longitudinal support.

The extension 74 is connected to tube 60 via a coupling 76 and is connected to a base 108 of the support member 112 at the pin joint 78. The pin joint 78 acts as a pivot about which the support member 112 rotates.

The coupling 76 connects the extension 74 to the tube 60. As depicted, the coupling 76 extends around an outer surface of the tube 60 to provide the necessary support for the support member 112 and all the mechanisms connected with the support member 112.

The support member 112 is connected to the rod 52 at the pin joint 110 and is connected to the extension 74 at the pin joint 78. The support member 112 also comprises two arms 80 and 82, the base 108, a coating 92 on the arm 80, and a coating 94 on the arm 82. The support member 112 is made from any suitably rigid material so as to properly support the musical instrument. Such rigid materials include wood, plastic, metal, combinations thereof, and so forth.

The coatings 92 and 94 are made of any suitably soft material that can protect the instrument from the rigid materials of the support member 112. Such soft materials include rubber, synthetic rubber, plastic, neoprene, combinations thereof, and so forth.

The base 108 of the support member 112 connect the arms 80 and 82 together. The base 108 rotates about the pin joint 78 and transfers its motion to the rod 52 via the pin joint 110.

Figure 4:
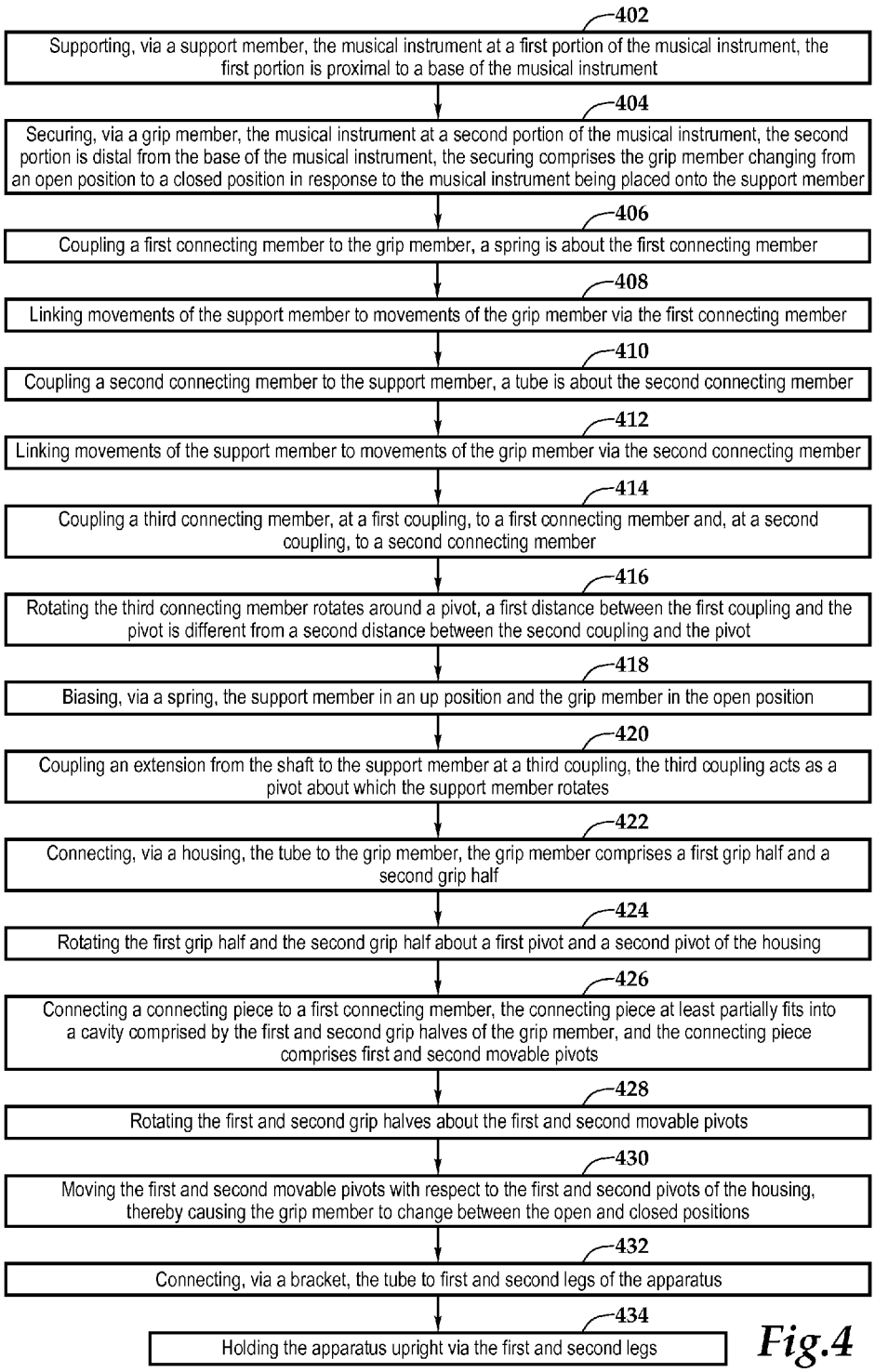
FIG. 4 is a flowchart illustrating a method that accords with the disclosure.

FIG. 4 is a flowchart illustrating a method that accords with the disclosure. At 402, an apparatus implementing the method provides for supporting, via a support member, the musical instrument at a first portion of the musical instrument, the first portion is proximal to a base of the musical instrument. When the musical instrument is a guitar, the support member supports the guitar at a base of the guitar.

At 404, an apparatus implementing the method provides for securing, via a grip member, the musical instrument at a second portion of the musical instrument, the second portion is distal from the base of the musical instrument, the securing comprises the grip member changing from an open position to a closed position in response to the musical instrument being placed onto the support member. When the musical instrument is a guitar, the second portion distal from the base includes the fretboard of the guitar up to the neck of the guitar. By having the grip member grip the guitar at the fretboard and not at the neck, the tuning of the guitar can be maintained even while the guitar is being securely stored.

At 406, an apparatus implementing the method provides for coupling a first connecting member to the grip member, a spring is about the first connecting member. The first connecting member could be a rod, a cable, and so forth.

At 408, an apparatus implementing the method provides for linking movements of the support member to movements of the grip member via the first connecting member. As such, the first connecting member provides sufficient tension to allow for linking the movements of the support member to the opening and closing of the grip member.

At 410, an apparatus implementing the method provides for coupling a second connecting member to the support member, a tube is about the second connecting member. The second connecting member could be a rod, a cable, and so forth.

At 412, an apparatus implementing the method provides for linking movements of the support member to movements of the grip member via the second connecting member. As such, the second connecting member provides sufficient tension to allow for linking the movements of the support member to the opening and closing of the grip member.

At 414, an apparatus implementing the method provides for coupling a third connecting member, at a first coupling, to a first connecting member and, at a second coupling, to a second connecting member. The third connecting member is made of sufficiently rigid material to transfer movements between the first connecting member and the second connecting member.

At 416, an apparatus implementing the method provides for rotating the third connecting member rotates around a pivot, a first distance between the first coupling and the pivot is different from a second distance between the second coupling and the pivot. By using different distances, heterogeneous movements between the first and second connecting members can be appropriately tuned so that appropriate movements of the support member cause appropriate opening and closing of the grip member.

At 418, an apparatus implementing the method provides for biasing, via a spring, the support member in an up position and the grip member in the open position. As shown in FIGS. 1, 2A, 2B, 3A, and 3B, the spring is compressed so that its expansion will press against the connecting piece 18 and the housing 32. Alternative embodiments can have a spring between the tube 60 and the base 108 of the support member 112. Such a spring would be stretched between tube 60 and base 108 so that it would contract and pull base 108 towards tube 60.

At 420, an apparatus implementing the method provides for coupling an extension from the tube to the support member at a second coupling, the second coupling acts as a pivot about which the support member rotates. The length of the extension may be chosen to achieve a desired amount of movement of the support member for its control of the grip member.

At 422, an apparatus implementing the method provides for connecting, via a housing, the tube to the grip member, the grip member comprises a first grip half and a second grip half. The grip member is made of a suitably rigid material and covered with a suitably soft material so that the grip member can safely secure the musical instrument.

At 424, an apparatus implementing the method provides for rotating the first grip half and the second grip half about a first pivot and a second pivot of the housing. The first and second pivots are stationary with respect to the housing.

At 426, an apparatus implementing the method provides for connecting a connecting piece to a first connecting member, the connecting piece at least partially fits into a cavity comprised by the first and second grip halves of the grip member, and the connecting piece comprises first and second movable pivots. The connecting piece comprises a cavity for each of the movable pivots.

At 428, an apparatus implementing the method provides for rotating the first and second grip halves about the first and second movable pivots. The first and second movable pivots move in conjunction with the connecting members and the support member.

At 430, an apparatus implementing the method provides for moving the first and second movable pivots with respect to the first and second pivots of the housing, thereby causing the grip member to change between the opened and closed positions. As such, while the first and second pivots of the housing remain stationary, the movable pivots move, thereby causing the rotational movement of the grip member that is based on the amount of movement of the support member.

At 432, an apparatus implementing the method provides for connecting, via a bracket, the tube to first and second legs of the apparatus. The legs are connected by pin joints that provide for rotation of the legs with respect to the bracket and allow for folding the legs closer to the center of the instrument stand for more compact storage of the instrument stand itself.

At 434, an apparatus implementing the method provides for holding the apparatus upright via the first and second legs. When properly positioned, the legs provide lateral and longitudinal support so that the stand may stay upright along with securely holding the musical instrument upright.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An apparatus for securely storing a musical instrument, the apparatus comprising:

a support member that supports the musical instrument at a first portion of the musical instrument, the first portion is proximal to a base of the musical instrument;

a grip member that secures the musical instrument at a second portion of the musical instrument, the second portion is distal from the base of the musical instrument, the grip member secures the musical instrument by changing from an opened position to a closed position in response to the musical instrument being placed onto the support member;

a spring that biases the support member in an up position and biases the grip member in the opened position.

2. The apparatus of claim 1, wherein the musical instrument is a guitar.

3. The apparatus of claim 1, further comprising:

a first connecting member to which is coupled the grip member and about which is a spring, movements of the support member are linked to movements of the grip member via the first connecting member.

4. The apparatus of claim 1, further comprising:

a second connecting member to which is coupled the support member and about which is a tube, movements of the support member are linked to movements of the grip member via the second connecting member.

5. The apparatus of claim 1, further comprising:

a third connecting member to which is coupled, at a first coupling, a first connecting member and to which is coupled, at a second coupling, a second connecting member, the third connecting member rotates around a pivot, and a first distance between the first coupling and the pivot is different from a second distance between the second coupling and the pivot.

6. The apparatus of claim 1, further comprising:

a tube through which passes a first connecting member that is coupled to the support member at a first coupling;

an extension from the tube, the extension coupled to the support member at a second coupling, the second coupling acts as a pivot about which the support member rotates.

7. The apparatus of claim 1, further comprising:

a tube through which passes a first connecting member that is coupled to the support member at a first coupling;

a housing that connects the tube to the grip member, the grip member comprises a first grip half and a second grip half and the first grip half and the second grip half each rotate about a first pivot and a second pivot of the housing.

8. The apparatus of claim 7, further comprising:

a connecting piece that connects to a second connecting member, that at least partially fits into a cavity comprised by the first and second grip halves of the grip member, and comprises first and second movable pivots about which the first and second grip halves rotate;

the first and second movable pivots move with respect to the first and second pivots of the housing, which causes grip member to change between the open and closed positions.

9. The apparatus of claim 1, further comprising:

a tube through which passes a first connecting member that is coupled to the support member at a first coupling;

a bracket that connects the tube to first and second legs of the stand;

the first and second legs hold the apparatus upright.

10. The apparatus of claim 1, further comprising:

coupling a second connecting member to the support member, a tube is about the second connecting member;

linking movements of the support member to movements of the grip member via the second connecting member.

11. The apparatus of claim 1, further comprising:

coupling a third connecting member, at a first coupling, to a first connecting member and, at a second coupling, to a second connecting member;

rotating the third connecting member around a pivot, a first distance that is between the first coupling and the pivot is different from a second distance that is between the second coupling and the pivot.

12. The apparatus of claim 1, further comprising:

passing a first connecting member through a tube, the first connecting member is coupled to the support member at a first coupling;

coupling an extension from the tube to the support member at a second coupling, the second coupling acts as a pivot about which the support member rotates.

13. The apparatus of claim 1, further comprising:

passing a first connecting member through a tube, the first connecting member is coupled to the support member at a first coupling;

connecting, via a housing, the tube to the grip member, the grip member comprises a first grip half and a second grip half;

rotating the first grip half and the second grip half about a first pivot and a second pivot of the housing.

14. The apparatus of claim 13, further comprising:

connecting a connecting piece to a second connecting member, the connecting piece at least partially fits into a cavity comprised by the first and second grip halves of the grip member, and the connecting piece comprises first and second movable pivots;

rotating the first and second grip halves about the first and second movable pivots;

moving the first and second movable pivots with respect to the first and second pivots of the housing, thereby causing the grip member to change between the opened and closed positions.

15. The apparatus of claim 1, further comprising:

passing a first connecting member through a tube, the first connecting member is coupled to the support member at a first coupling;

connecting, via a bracket, the tube to first and second legs of the apparatus;

holding the apparatus upright via the first and second legs.

16. A method of an apparatus for securely storing a musical instrument, the method comprising:

supporting, via a support member, the musical instrument at first portion of the musical instrument, the first portion is proximal to a base of the musical instrument;

securing, via a grip member, the musical instrument at a second portion of the musical instrument, the second portion is distal from the base of the musical instrument, the securing comprises the grip member changing from an opened position to a closed position in response to the musical instrument being placed onto the support member; and biasing, via a spring, the support member in an up position and the grip member in the open position.

17. The method of claim 16, wherein the musical instrument is a guitar.

18. The method of claim 16, further comprising:

coupling a first connecting member to the grip member, a spring is about the first connecting member;

linking movements of the support member to movements of the grip member via the first connecting member.

* * * * *